United States Patent [19]

Bartunek et al.

[11] 4,268,894

[45] May 19, 1981

[54] PORTABLE WATERPROOF FLUORESCENT LANTERN

[75] Inventors: William Bartunek, Yonkers, N.Y.; Henry R. Mallory, Greenwich, Conn.

[73] Assignee: Duracell International Inc., Bethel, Conn.

[21] Appl. No.: 17,216

[22] Filed: Mar. 5, 1979

[51] Int. Cl.[3] ..... F21L 7/00

[52] U.S. Cl. ..... 362/158; 362/183; 362/186; 362/200; 362/221; 362/217

[58] Field of Search ..... 362/157, 158, 183, 184, 362/186, 200, 221, 217

[56] References Cited

U.S. PATENT DOCUMENTS

| | | | |
|---|---|---|---|
| 2,176,301 | 10/1939 | Haas | 362/158 |
| 2,438,012 | 3/1948 | Laidig | 362/221 |
| 2,641,685 | 6/1953 | Pessina | 362/157 |
| 2,668,229 | 2/1954 | Akroyd | 362/158 |
| 3,450,471 | 6/1969 | Lessler | 362/183 |
| 3,604,920 | 9/1971 | Niles | 362/221 |
| 3,767,904 | 10/1973 | Cook | 362/184 |
| 3,794,825 | 2/1974 | Krupansky | 362/158 |
| 3,947,678 | 3/1976 | Tang . | |
| 3,953,768 | 4/1976 | Meredith et al. | 362/183 |
| 3,978,330 | 8/1976 | Maurer | 362/158 |
| 4,074,122 | 2/1978 | Moore . | |
| 4,156,893 | 5/1979 | Baake | 362/186 |

*Primary Examiner*—Monroe H. Hayes
*Attorney, Agent, or Firm*—Ronald S. Cornell; Israel Nissenbaum; Martin M. Glazer

[57] ABSTRACT

A portable waterproof fluorescent lantern having a case impervious to the entry of water, a fluorescent lamp within the case, a self-contained power source within the case for powering the lamp and means for activating the power source which is waterproof and operatively associated with the case.

9 Claims, 6 Drawing Figures

PORTABLE WATERPROOF FLUORESCENT LANTERN

FIELD OF THE INVENTION

This invention is related to portable battery powered fluorescent lanterns and more particularly to lanterns that are waterproof and have a runaway protected inverter-ballast circuit.

BACKGROUND OF THE INVENTION

The development of the incandescent bulb and the electrochemical cell has led to the development of the flashlight and similar portable light systems based on the incandescent bulb. Such flashlights, however, are not wholly satisfactory and even with all of the improvements made over the years the incandescent lamp flashlight still has inherent problems.

The flashlight is an inefficient light source due to the very low efficiency of the incandescent lamp in converting electrical energy into visible light. Much of the electrical energy consumed by the incandescent lamp is converted into heat, which is dissipated into the environment without serving any useful function. The low efficiency of the incandescent lamp has usually required the lamp to be used with a parabolic or similar reflector. Further, the incandescent lamp employs a filament which produces a point source of light, the reflector concentrates this point source of light into a narrow beam producing an uneven spot type illumination.

With the invention of the fluorescent lamp an alternative light source became available. The fluorescent lamp is much more efficient in converting electrical energy into visible light than is an incandescent lamp. This high efficiency makes the fluorescent lamp an ideal replacement for the incandescent lamp in many applications. The higher efficiency of the fluorescent lamp is particularly attractive for portable light uses, where the amount of electrical energy available is fixed and limited to that contained in the batteries present within the lantern.

A fluorescent lamp generates light on the inner surface of the lamp envelope. This produces a much more diffuse light than the point source generated by the incandescent lamp. The diffuse light, coupled with the larger amount of light available, permits the lamp to be used with a flat reflector. This produces a more even illumination over a much larger area than the small uneven spot produced by an incandescent lamp.

A fluorescent lamp requires a ballast circuit and a supply of alternating current at a high frequency and at a much higher voltage than the direct current required by the incandescent lamp. This higher voltage in portable fluorescent lanterns is supplied by a self-contained power source, usually an inverter-ballast circuit powered by batteries. The efficiency of this circuit in converting the direct current supplied by the batteries into the high alternating current voltage required by the fluorescent lamp determines the amount of light and the total number of hours of light obtained from a given set of batteries and fluorescent lamp. The higher the efficiency of the inverter-ballast circuit the more hours of light will be obtained from a given set of batteries.

The higher voltage required by a fluorescent lamp causes difficulties in the design of the lantern case. One such difficulty is that the high voltage, after being produced, must be channeled to the lamp without being reduced or permitted to leak out of the case. Leakage reduces the efficiency of the lantern. No such potential problems existed with incandescent lamps because of the low direct current associated with those lamps.

The high voltage lamp requires several batteries in series to supply the voltage and current needed by the inverter-ballast circuit to properly operate the fluorescent lamp. The large number of batteries in turn dictates a case that will not be damaged by impact, which would be accentuated by the increased number of batteries required.

The previously recited problems can be further compounded by when and how the portable fluorescent lantern is used. Portable lanterns are usually used outside of the controlled environment of the home or office. Fluorescent lanterns will usually be found in backyards, on campgrounds and on boats. The high humidity found in all these environments increases the likelihood of voltage leakage. Battery contact corrosion accelerated by high humidity reduces the voltage at the inverter-ballast input. The presence of bodies of water or rain in areas of lantern use, creates the possibility of lantern failure on lantern submersion or penetration by water. These events usually occur at a time when the lantern is most needed, as in a storm.

The entry of water, especially salt water even in very small quantities, is detrimental to conventional portable fluorescent lanterns. Water actively promotes corrosion within the lantern, which increases the resistance of all electrical contacts, resulting in decreased light output and eventual lantern failure. Further, water provides a leakage path for the alternating current voltage produced within the lantern. This also reduces the voltage reaching the lamp and reduces the light output and efficiency of the lantern. Corrosion and leakage paths are of especial concern in the area of the inverter-ballast circuit. The various components of the inverter-ballast circuit are very close to each other, and corrosion and leakage paths will quickly cause the total failure of the circuit.

Even if no moisture enters the lantern, previously known lanterns have malfunctioned due to failure of the mechanical switches previously used. Through the abuse or, in many cases simply through their use, the mechanical switches failed or developed high resistance. This led to reduced light output and ultimately to failure of the lantern.

A further problem encountered in fluorescent light systems occurred because the fluorescent lamp acts as a load on the inverter-ballast circuit and removal of the lamp during circuit operation can cause inverter runaway and subsequent failure of the self-contained power source. For this reason, in the past, care had to be taken by the usually unaware user to make sure that the circuit was switched off or the batteries removed before the lamp was removed from the lantern.

THE INVENTION

A portable fluorescent lantern has now been invented that is waterproof, utilizes a reliable waterproof switching means, illuminates a large area and contains a runaway-protected inverter-ballast circuit.

The lantern is made impervious to water through the use of gaskets between the various parts of the case and the novel use of a waterproof switch that requires no physical opening in the case through which water could enter. A pair of mating threaded portions, the means for locking the case, supplies the tension to maintain the compression of the case sections against the gaskets, which compression insures a waterproof seal. The means also serves to hold and lock the case sections in place during the rugged use to which such lanterns are subjected.

The preferred waterproof switch comprises a magnet, movably mounted on the case exterior and one or more reed switches mounted within the case. The reed switches are sealed in an inert gas envelope and therefore are far less susceptible to mechanical failure and corrosion, (and the concomitent increase in electrical resistance) than previously known mechanical switches. This greatly improves the reliability of the lantern.

Previously known mechanical switches, due to the various actions required of the components in the making and breaking of the electrical connection, were subject to failure due to metal fatigue, material failure, and corrosion and were highly susceptible to physical abuse. Reed switches, whose contacts need only move a few millimeters to make and break electrical contact, and whose movements are controlled by a magnet, are far less subject to these problems. Further, the magnet and other related portions of the waterproof switch are also highly resistant, if not immune, to the problems associated with previously known mechanical switches, further increasing the reliability of the switch and lantern.

Also in accordance with the present invention, the inverter-ballast circuit is protected from runaway by the placing of a switch, which can only be actuated by the fluorescent lamp, within the self-contained power source. The switch interconnects the batteries or auxiliary power connector and the inverter-ballast circuit. When the lamp is placed within the lantern the switch is automatically closed and the circuit operates properly. When the lamp is removed, the switch opens and disconnects the circuit from the batteries or auxiliary power.

These and other advantages of the invention will be apparent from the following discussion as well as from the drawings.

DETAILED DESCRIPTION OF THE DRAWINGS

Figure 1:
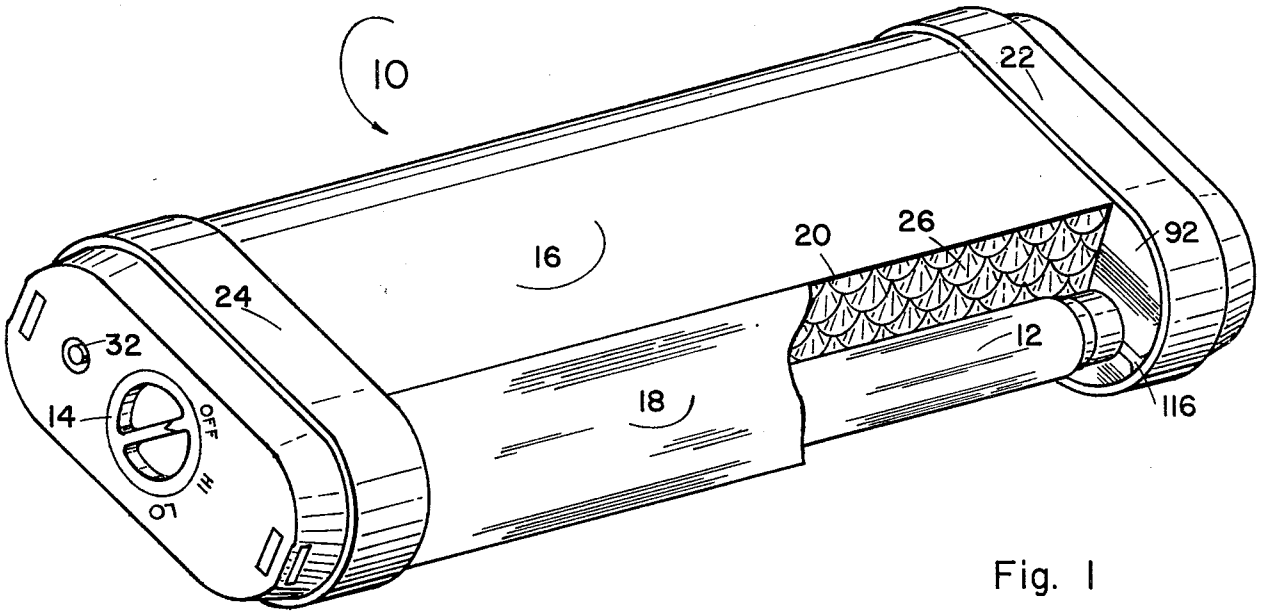
FIG. 1 is an isometric view of the portable waterproof lantern of the invention.

Referring now to the drawings, FIG. 1 shows the portable waterproof lantern 10 of the invention as being comprised of a case impervious to the entry of water, a fluorescent lamp 12, a self-contained power source (not shown) within the case and means 14 for activating the power source operatively associated with the case. The actuating means 14 is waterproof which eliminates one source of leakage of the case.

The case is formed of a partially transparent, substantially continuous outer shell 16 with a transparent section 18 covering the lamp 12 and lamp reflector 20. One end of the shell 16 is permanently and hermetically attached to an end cap 22, which is shown and more fully discussed in FIGS. 3 and 4. A second end cap 24 is permanently attached to the self-contained power source or one piece battery holder as more fully shown in FIG. 2.

The reflector 20 of the preferred embodiment is flat and is comprised of an embossed, reflective surface and a clear protective layer over the embossed layer. The reflective surface is embossed with a multiplicity of concentric semi-circles 26. The semi-circles 26 have been further embossed so that each is pearlescent. The reflector 20 appears to be comprised of a multiplicity of pearlescent semi-circles 26. Reflectors having shapes and materials other than shown in FIG. 1 can also be used in the lantern 10 to alter the light output of the lantern 10.

Figure 2:
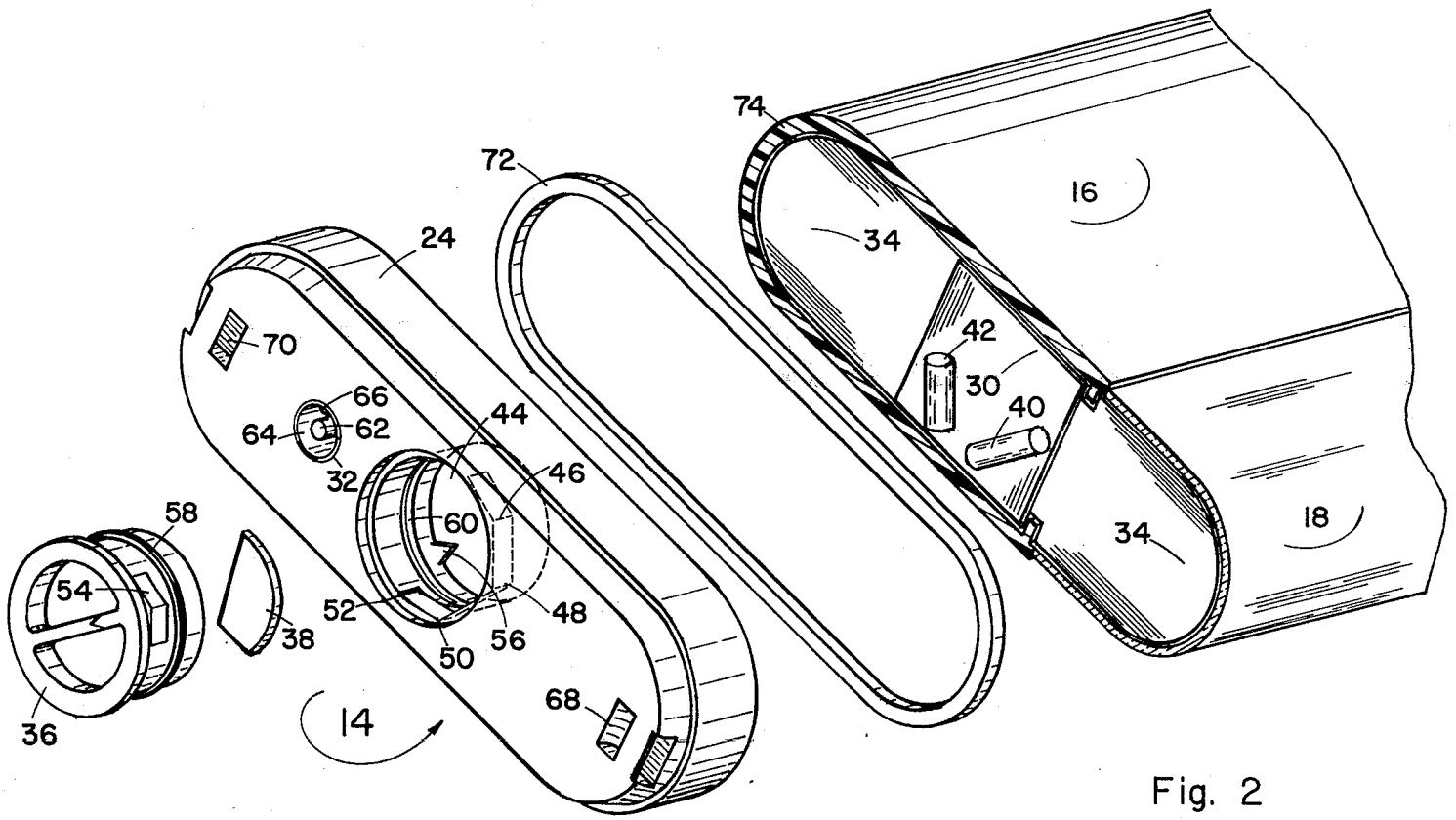
FIG. 2 is an exploded isometric view of the means for activating the power source.

The means 14 for activating the power source, shown in detail in FIG. 2, controls the flow of current into an inverter-ballast circuit 30 from an auxiliary connector 32 or from batteries (shown in FIG. 4) in the battery holder or self-contained power source 34. The circuit 30 is shown as being located on the self-contained power source 34 but can be incorporated into a different portion of the lantern 10.

The means 14 comprises a disc 36 with means for producing a magnetic field such as a permanent magnet 38 mounted on the side of the disc 36 facing the end cap 24. The magnet 38 produces a magnetic field which passes through the end cap 24 and closes either one or both magnetically activatable reed switches 40, 42 located on the inverter-ballast circuit 30. Since the magnetic field is able to pass through the nonferrous material comprising the end cap 24, no physical passageway is necessary in the end cap 24 for the magnet 38 to open and close the reed switches 40, 42. Without such an opening the means 14 is waterproof, and this, in combination with other sealing means discussed in relation to the other figures, insures a waterproof lantern 10.

The disc 36 is pivotally mounted within a recess 44 on the end cap 24. The recess 44 has a roughly circular shape being formed of a semicircle closed in by three walls. The walls form four corners 46, 48, 50, 52 where they join and where they meet the semicircle.

The corners 46, 48, 50, 52 are designed to receive a detent 54 in a snap-in fashion. The detent 54 is located on the means to position the detent, which in the preferred embodiment is the circular disc 36. When the detent 54 is in corner 50, the magnet 38 is aligned so that both reed switches 40, 42 close, and in combination with the preferred inverter-ballast circuit 30, the lamp 12 produces a high light output. When the detent 54 is in corner 52, only one of the reed switches 40 closes and the lamp 12 produces a lower light output. Both reed switches 40, 42 are open and no light is produced when the detent is in corner 48. Corner 41 is not used in the preferred embodiment shown.

The disc 36 is prevented from rotating beyond corners 48 and 52 by a pair of triangular projections 56, only one of which is shown in FIG. 1. When the detent 54 is rotated into corner 48, a stop (not shown), located on the same side of the disc 36 as the magnet 38, contacts the triangular projections 56 and further rotation beyond the corner 48 is prevented. Similarly when detent 54 is rotated into corner 52, the stop contacts the second projection and further rotation is prevented.

The disc 36 is held in place within the recess 44 by a matching ring 58 and groove 60. The ring 58 located on the side of the disc 36 engages the groove 60 located on the side of the recess 44. The ring 58 once engaged with the groove 60, is difficult to dislodge making the disc 36 difficult to dislodge from the recess 44. The ring 58 moves within the groove 60 when the disc 36 is rotated and helps to hold the magnet 38 in proper alignment during use of the lantern 10. Although the reed switches 40, 42 are mounted on the circuit 30 for convenience, they can be mounted anywhere so long as they can reliably be opened and closed by the magnet 38.

A single reed switch (not shown) can also be employed in the lantern 10, only one light level will then be produced by the lantern 10. More than two reed switches (not shown) or other magnetically actuable switches (not shown) can also be incorporated into the waterproof switch 14. These switches can be used to start and stop the output of the inverter ballast circuit 30 and to increase or decrease the light output of the lamp 12. Other inverter ballast circuits (not shown) in combination with the magnet 38 and reed 40, 42 of the present invention or other combinations of magnetically actuable switches can also be used in the lantern 10 of the present invention. Further, other waterproof switching means (not shown) can also be incorporated into the lantern 10, the present invention not being limited to the preferred switching means 14 disclosed.

The end cap 24 also contains means for supplying auxiliary power to the inverter ballast circuit 30. In the preferred embodiment shown in FIG. 2 the means is the polarized auxiliary power connector 32. The connector 32 is shown as being polarized by having a central contact 62 of one polarity, insulated from an outer ring 64 containing a contact 66 of opposite polarity. The auxiliary power connector 32 used with the lantern 10 is made waterproof through the use of a layer of potting compound (not shown) applied to the portion of the connector 32 within the lantern 10.

A mating connector (not shown) is complementarily constructed and would thus always be connected in the proper polarity. With the mating connector in place, the lantern 10 is used without batteries and draws power from an outside source. The mating connector is designed to convert the power produced by the outside source, such as an automobile electrical system, into the voltage required by the lantern 10.

The means for supplying auxiliary power is not required. Further, it can be of many other constructions than the preferred embodiment shown, depending on the requirements of the lantern user.

The second end cap 24 is shown as containing a provision for the attachment of a carrying strap (not shown). The provision comprises a pair of rectangular tunnels 68, 70 passing through the end cap 24. A portion of the carrying strap is adapted to pass through the tunnels 42, 44 and secure the strap to the end cap 24. Various other handles (not shown) can also be attached to the tunnels 68, 70 or to other portions of the lantern 10.

A gasket 72, which is used to seal the lantern 10 in a waterproof mode, is shown between the shell 16 and end cap 24. When the means for locking the case (shown in FIGS. 3 and 4) is locked, the open end 74 of the outer shell 16 is forced against one side of the gasket 72. The other side of the gasket 72 is simultaneously forced against an inner surface (not shown) of the end cap 24. The gasket 72 forms an hermetic seal between the end 74 of the shell 16 and the end cap 24 by filling any irregularities between the two components 16, 24.

Figure 3:
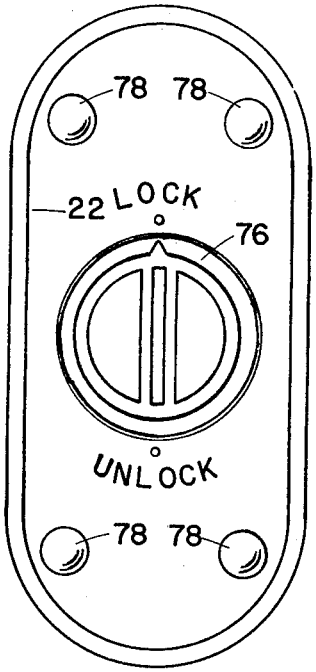
FIG. 3 is a plan view of the front of one end cap of the lantern.

A flat plan view of the end cap 22 containing the means for locking the case is shown in FIG. 3. In this figure, only the external surface of a female threaded portion 76, which comprises part of the means for locking the case, is shown in place.

Four small bumps 78 project from the surface of the end cap 22. The bumps 78 form a base upon which the lantern 10 is rested during use or storage. The bumps 78 also protect the surface of the end cap 22 and projecting parts of the female threaded portion 76 from damage when the lantern 10 is rested on the end cap 22.

Figure 4:
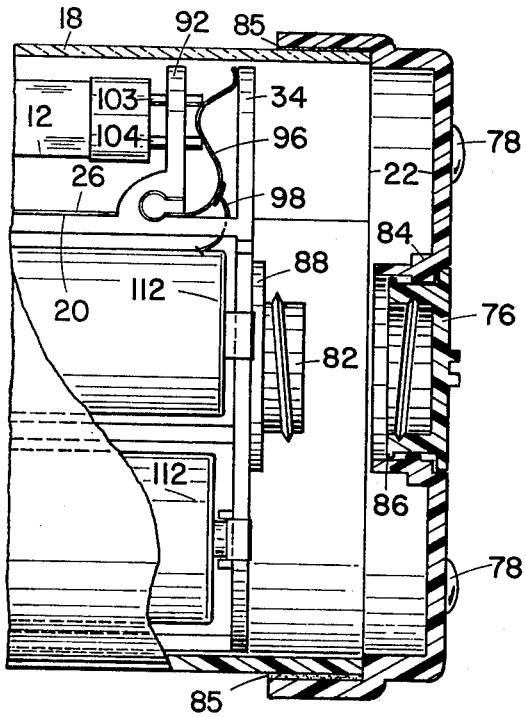
FIG. 4 is a cross-sectional view of one end cap shown with the threaded mating portions disengaged.

The means for locking the case is shown disengaged and in partial cross section in FIG. 4. The means comprise female 76 and male 82 threaded mating portions. The male portion 82 is shown as integrally formed with the battery holder or self-contained power source 34 but can also be rigidly attached to it. The female portion 76 is held captive within a rimmed aperture 84 in the first end cap 22. The end cap 22 is firmly and hermetically attached to the open end of the shell 16 by an adhesive layer 85.

When the self-contained power source or battery holder 34 is inserted into the shell 16, the male threaded portion 82 contacts the female portion 76. Rotating the female portion 76 engages the threads and simultaneously forces the rim 86 of the aperture 84 against a gasket 88. The gasket 88 is shown as an annular ring around the male threaded portion 82.

The pressure of the rim 86 on the gasket 88 forms a waterproof seal between the two, preventing the entry of water through the end cap 22 and means for locking the case. The second end cap 24 is now also sealed against the shell 16 with gasket 72 as shown in FIG. 2. The combination of gaskets 72 and 88 seals the lantern 10 case and puts it in a waterproof mode.

The present invention is not limited to the above described means for locking and sealing the case. Other means can also be utilized in the present invention.

Figure 5:
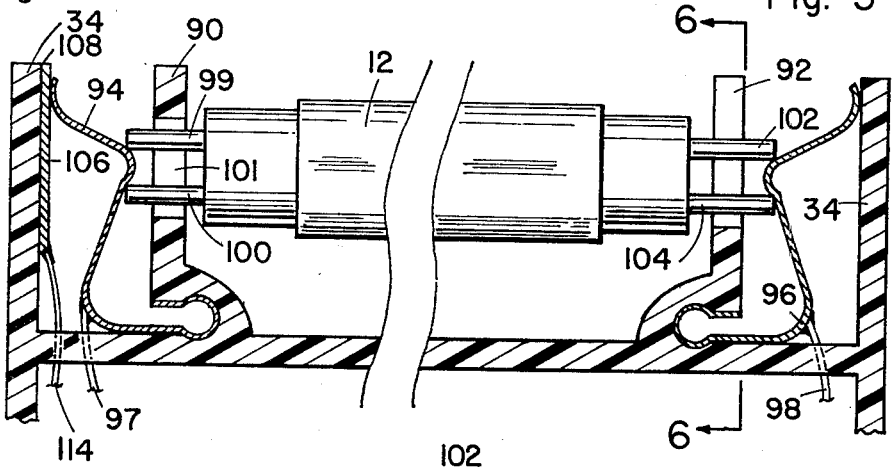
FIG. 5 is a broken cross-sectional view of means for holding the lamp in place including the lamp actuated switch.

Means for holding the lamp 12 in place and electrically connecting it to the inverter-ballast circuit 30 is shown in part in FIG. 4 and shown enlarged in FIG. 5. The means comprise a pair of flanges 90, 92 integrally formed on either side of the self-contained power source 34 and a spring contact 94, 96 held in place in each flange 90, 92, respectively. Each spring contact 94, 96 is electrically connected to one of the outputs of the inverter-ballast circuit 30 by wires 97 and 98 respectively.

The lamp 12 is placed into position in the means by first inserting a pair of prongs 99, 100 located at one end of lamp 12, into an aperture 101 in the first flange 90. The prongs 99, 100 pass through the aperture 101 and contact the spring contact 94. A pair of prongs 102, 104 on the other end of the lamp 12 are then pushed into a groove (shown in FIG. 6) located in the second flange 92. When these prongs 102, 104 contact the spring contact 96, both spring contacts 94, 96 are compressed as the prongs 102, 104 are forced into the groove. The raised portion of the contacts 94, 96 is shown in place between prongs 99, 100 and between prongs 102, 104.

The lamp 12 is held in place in the flanges 90, 92 by the spring tension of the two spring contacts 94, 96. Since the spring contacts 94, 96 are electrically connected to the inverter-ballast circuit 30 the lamp 12 is now also electrically connected to the circuit 30 and will produce light when the circuit 30 is energized.

Due to the fact that the raised portion of the spring contacts 94, 96 is between the prongs 99, 100 and 102, 104, the spring contacts 94, 96 must be compressed before the lamp 12 can be removed from the flanges 90, 92. Further, when removing the lamp 12 from the power source 34, the prongs 102, 104 must be removed from the groove in flange 92 first, since the aperture 101 prevents the other prongs 99, 100 from being removed first. The combination of the shaped spring contacts 94, 96, the aperture 101 and grooved flange 92, virtually eliminates unintentional dislodgement of the lamp 12 from the power source 34, even under high vibration and shock.

The spring contact 94 in combination with a contact plate 106 located on a surface 108 of the self-contained power source 34, forms a lamp activated switch. The switch is designed to prevent inverter-ballast circuit 30 runaway, which can occur if the lamp 12 is disconnected from the circuit 30 while the circuit 30 is still connected to and drawing power from the direct current power source 34.

The spring contact 94 is electrically connected to the collector electrode of the transistor of the inverter-ballast circuit 30 (not shown) and to the output of the circuit by the wire 97. The contact plate 106 is electrically connected to the positive terminal of a battery 112 (shown in FIG. 4) or the auxiliary connector 32 (shown in FIGS. 1 and 2) by a second wire 114. When the prongs 99, 100 of the lamp 12 are in place in the flange 90, the contact 94 is forced against the contact plate 106 and the electrical circuit between the batteries 112 and the inverter-ballast circuit 30 is closed. When the lamp 12 and the prongs 99, 100 are removed from the flange 90, the spring contact 94 moves away from the contact plate 106 disconnecting the circuit 30 from the source of current and thereby preventing circuit runaway.

Figure 6:
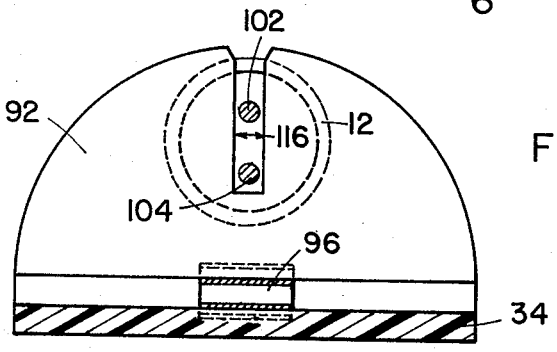
FIG. 6 is a cross-sectional view of one flange holding the lamp.

The two prongs 102, 104 projecting from the lamp 12 are shown, in FIG. 6, in place in the groove 116 located in the flange 92. The flange 92 is shown projecting from the self-contained power source 34 and the spring contact 96 is shown in place in the flange 92.

The preceeding description of a specific embodiment of the invention was for illustrative purposes only. It is understood that changes and variations can be made without departing from the spirit and scope of the present invention as defined in the following claims.

What is claimed is:

1. A portable waterproof fluorescent lantern comprising a case impervious to the entry of water, said case comprising a partially transparent, substantially continuous outer shell having first and second open ends, a first cap covering and permanently sealed to the first open end, and a second cap firmly attached to the first end of the battery holder and capping the second open end of said outer shell; a fluorescent lamp within said case; a self-contained power source within said case for powering said lamp, said self-contained power source comprising a battery holder having first and second ends; means for activating said self-contained power source operatively associated with said case, said means being sealed to maintain said case in a waterproof condition; means for locking the case comprising a pair of mating male and female threaded elements, one element being located on the second end of the battery holder, and the second mating threaded element being rotatably situated in the first end cap; a first gasket operatively associated with the second open end and the second cap; and a second gasket operatively associated with said threaded mating elements whereby upon the complete mating of the elements said lantern is rendered waterproof.

2. The lantern of claim 1 and further comprising a waterproof auxiliary power connector located on said case.

3. The lantern of claim 2 wherein the base of said auxiliary power connector is sealed by a layer of waterproof potting compound.

4. The lantern of claim 1 wherein said end caps are noncylindrical.

5. The lantern of claim 1 wherein said means for activating said power source comprises a magnetically actuatable switch within said case and means outside of said case for producing a magnetic field and being positioned so that upon a predetermined movement the magnetic field will actuate said switch through said case.

6. The lantern of claim 5 wherein said case has a recessed portion and said means for activating said power source further comprises a plurality of corners in the perimeter of the recess on said case, and means for positioning a detent in the corners in a snap-in fashion located on said means for producing a magnetic field whereby the magnetic field is properly positioned with respect to the magnetically actuatable switch.

7. The lantern of claim 1 wherein said self-contained, power source further comprises a fluorescent lamp actuated switch wherein said self-contained power source is actuatable only when said lamp is completely connected to said self-contained power source.

8. The lantern of claim 7 wherein said lamp actuated switch comprises a pair of flanges; a pair of spring contacts, one contact associated with each flange so that said fluorescent lamp is held in place between the spring contacts and flanges; and a contact plate associated with one spring contact so that the fluorescent lamp, when completely connected to said self-contained power source, holds the spring contact against the contact plate.

9. The lantern of claim 1 wherein said means for activating said self-contained power source comprises two magnetically actuatable switches within said case and means outside of said case for producing a magnetic field; said two switches being so positioned relative to each other and to the means for producing a magnetic field that a predetermined movement of the magnetic field will actuate one of said switches and a different predetermined movement of the magnetic field will actuate both of said switches whereby the output of said power source will vary with the position of said means for producing a magnetic field.

* * * * *